US010021481B2

(12) United States Patent
Akino

(10) Patent No.: US 10,021,481 B2
(45) Date of Patent: Jul. 10, 2018

(54) MICROPHONE JOINT

(71) Applicant: Hiroshi Akino, Kanagawa (JP)

(72) Inventor: Hiroshi Akino, Kanagawa (JP)

(73) Assignee: Audio-Technica Corporation, Tokyo (JP)

( * ) Notice: Subject to any disclaimer, the term of this patent is extended or adjusted under 35 U.S.C. 154(b) by 0 days.

(21) Appl. No.: 15/438,940

(22) Filed: Feb. 22, 2017

(65) Prior Publication Data

US 2017/0339486 A1 Nov. 23, 2017

(30) Foreign Application Priority Data

May 17, 2016 (JP) ..... 2016-099007

(51) Int. Cl.

| | |
|---|---|
| ***H04R 9/08*** | (2006.01) |
| ***H04R 1/32*** | (2006.01) |
| ***H04R 1/08*** | (2006.01) |
| ***H01R 13/622*** | (2006.01) |
| ***H01R 35/04*** | (2006.01) |
| ***H01R 33/94*** | (2006.01) |

(52) U.S. Cl.

CPC ..... *H04R 1/326* (2013.01); *H01R 13/622* (2013.01); *H01R 33/94* (2013.01); *H01R 35/04* (2013.01); *H04R 1/08* (2013.01)

(58) Field of Classification Search

CPC ..... H04R 1/326; H04R 1/08; H01R 13/622; H01R 33/94; H01R 35/08

USPC ..... 381/356

See application file for complete search history.

(56) References Cited

U.S. PATENT DOCUMENTS 7,112,106 B1 * 9/2006 Su ..... H01R 4/5091 439/784

OTHER PUBLICATIONS

"Capsule Swivel GVC", Schoeps Mikrofone, May 12, 2016, Web, http://schoeps.de/en/products/gvc.

* cited by examiner

*Primary Examiner* — Sunita Joshi

(74) *Attorney, Agent, or Firm* — W&C IP

(57) ABSTRACT

A microphone joint is provided that includes movable parts having preferable electrical connection, movability, and fixing force. The microphone joint is to be coupled to a unit case accommodating a microphone unit and a connector case accommodating a connector configured to output signals from the microphone unit to an external device. The microphone joint includes a first unit to be coupled to the unit case, a second unit to be coupled to the connector case, and a conductive member disposed between the first unit and the second unit. The first unit is supported by the second unit with the conductive member and is rotatable relative to the second unit. The conductive member has resilience.

9 Claims, 9 Drawing Sheets

MICROPHONE JOINT

TECHNICAL FIELD

The present invention relates to a microphone joint.

BACKGROUND ART

Some microphones are of a stick type and include replaceable microphone units. A typical microphone including a replaceable microphone unit has an element part and a power module part, for example. The element part includes the microphone unit. The power module part includes a circuit board for processing electrical signals from the microphone unit.

Some microphones have been proposed each including a movable joint coupled between the element part and the power module part to make the sound collecting axis of the microphone unit adjustable (for example, the "Capsule Swivel GVC" available from Schoeps GmbH, Karlsruhe, Germany).

The joint used in the Capsule Swivel GVC is a so-called swivel joint including a first unit to be coupled to the element part and a second unit to be coupled to the power module part. The first unit includes a hemispherical first movable member. The second unit includes a hemispherical second movable member. The first movable member and the second movable member are composed of metal having the same shape.

The first movable member is attached to the second movable member. The open end of the first movable member abuts on the open end of the second movable member. The first movable member is rotatable relative to the second movable member along the circumferential direction of the second movable member within a predetermined range of angle. The second movable member is rotatable relative to the first movable member along the circumferential direction of the first movable member within a predetermined range of angle.

Thus, the first unit and the second unit are rotatable relative to each other, having the first movable member and the second movable member function as movable parts. When the movable parts rotate relative to each other, the open end of the first movable member and the open end of the second movable member slide on each other.

As described above, the first movable member and the second movable member are composed of metal. Thus, the open end of the first movable member abuts on the open end of the second movable member at a limited number of points. As the number of points of contact increases, the electrical connection between the first movable member and the second movable member becomes more certain, whereas the frictional force between the first movable member and the second movable member increases. As this frictional force increases, the movability of the first movable member decreases, whereas the force (hereinafter referred to as "fixing force") of fixing the rotational position (the angle of the first movable member from the second movable member) of the first movable member relative to the second movable member increases. In other words, the frictional force between the first movable member and the second movable member affects the electrical connection, movability, and fixing force in the movable parts (between the two units).

SUMMARY OF INVENTION

Technical Problem

As the frictional force decreases, the electrical connection of the movable parts becomes uncertain, the movability of the movable parts increases, and the fixing force in the movable parts decreases. As a result, the electromagnetic (electrostatic) shield of the microphone becomes uncertain (unstable) in the joint, fixing of the sound collecting axis of the microphone unit becomes more difficult, whereas adjusting (changing) of the sound collecting axis of the microphone unit becomes easier. In this case, the electromagnetic waves emitted from devices, such as cellular phones, near the joint readily enter the microphone through the joint. As a result, the electromagnetic waves interfere with components, such as electronic components included in the microphone, and the microphone unit generates noises.

On the other hand, as the frictional force increases, the electrical connection of the movable parts becomes more certain, the movability of the movable parts decreases, and the fixing force in the movable parts increases. As a result, the electromagnetic shield of the microphone becomes certain, fixing of the sound collecting axis of the microphone unit becomes easier, whereas adjusting (changing) of the sound collecting axis of the microphone unit becomes more difficult.

As described above, an increase in the electrical connection or the fixing force in the movable parts is incompatible with an increase in the movability of the movable parts.

An object of the present invention is to solve the problem described above, and to provide a microphone joint including movable parts having preferable electrical connection, movability, and fixing force.

Solution to Problem

The microphone joint of the present invention is to be coupled to a unit case accommodating a microphone unit and a connector case accommodating a connector configured to output signals from the microphone unit to an external device. The microphone joint includes a first unit to be coupled to the unit case, a second unit to be coupled to the connector case, and a conductive member disposed between the first unit and the second unit. The first unit is supported by the second unit with the conductive member and is rotatable relative to the second unit. The conductive member has resilience.

According to the present invention, a microphone joint including movable parts having preferable electrical connection, movability, and fixing force can be provided.

DESCRIPTION OF EMBODIMENTS

Microphone Joint

Embodiments of the microphone joint will now be described with reference to the attached drawings.

Configuration of Microphone Joint

Figure 1:
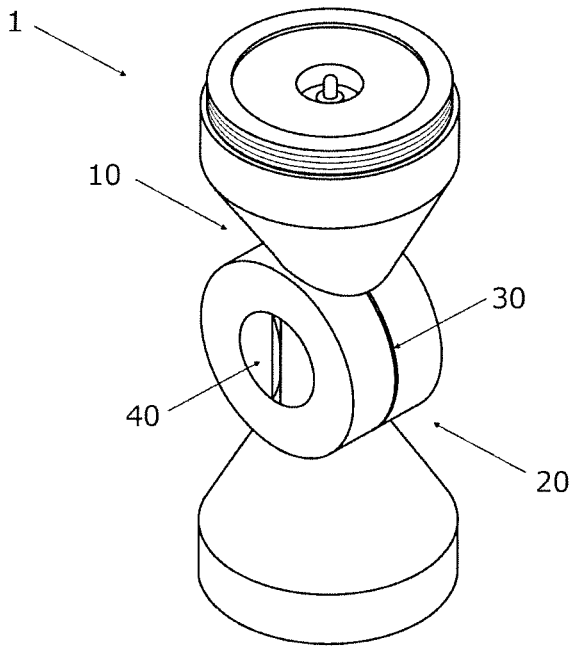
FIG. 1 is a perspective view of an embodiment of a microphone joint according to the present invention.

FIG. 1 is a perspective view of a microphone joint according to an embodiment of the invention.

A microphone joint (hereinafter referred to as "joint") 1 is configured to be coupled to a unit case C1 (see FIG. 13) and a connector case C2 (see FIG. 13) of a microphone M (see FIG. 13) and adjusts the sound collecting axis of a microphone unit of the microphone M. The microphone M will be described below.

The joint 1 includes a first unit 10, a second unit 20, a conductive member 30, and a coupling member 40.

Figure 2:
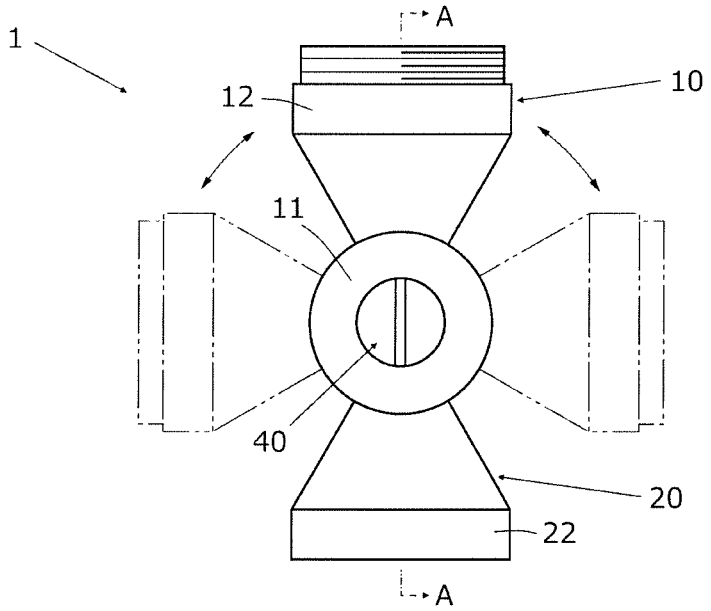
FIG. 2 is a front view of the microphone joint in FIG. 1.

FIG. 2 is a front view of the joint 1.

The two dotted chain lines of FIG. 2 indicate states of the first unit 10 rotating relative to the second unit 20. The rotation of the first unit 10 and the second unit 20 will be described below.

Figure 3:
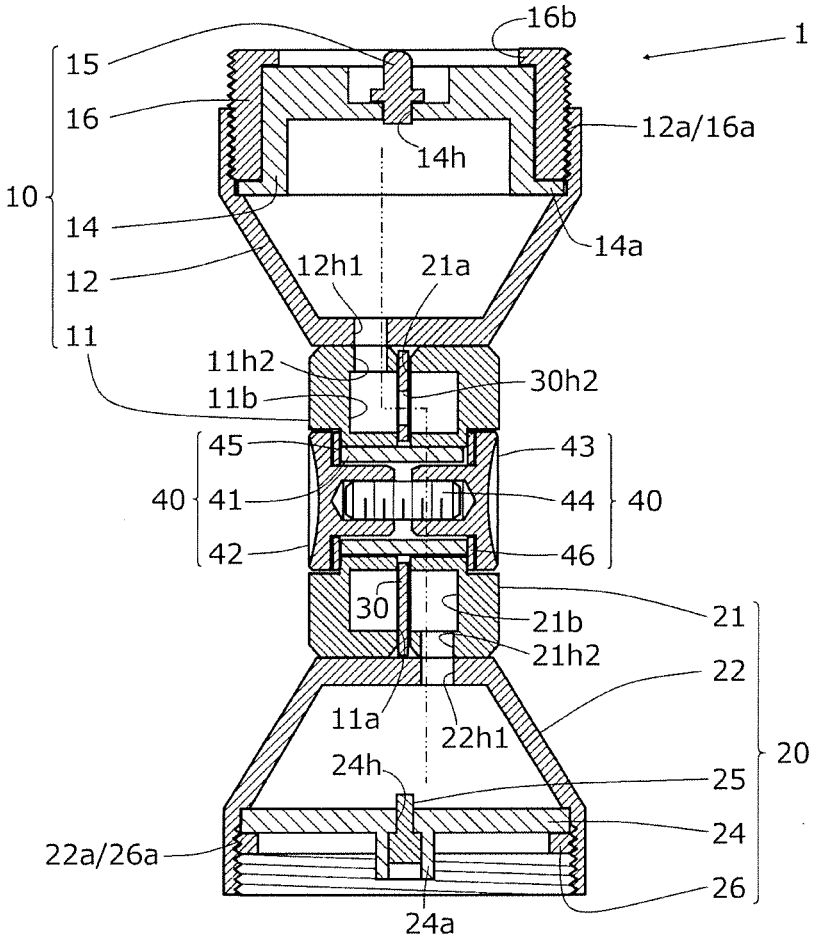
FIG. 3 is a cross-sectional view of the microphone joint taken along the line A-A of FIG. 2.

FIG. 3 is a cross-sectional view of the joint 1 taken along the line A-A of FIG. 2.

Figure 4:
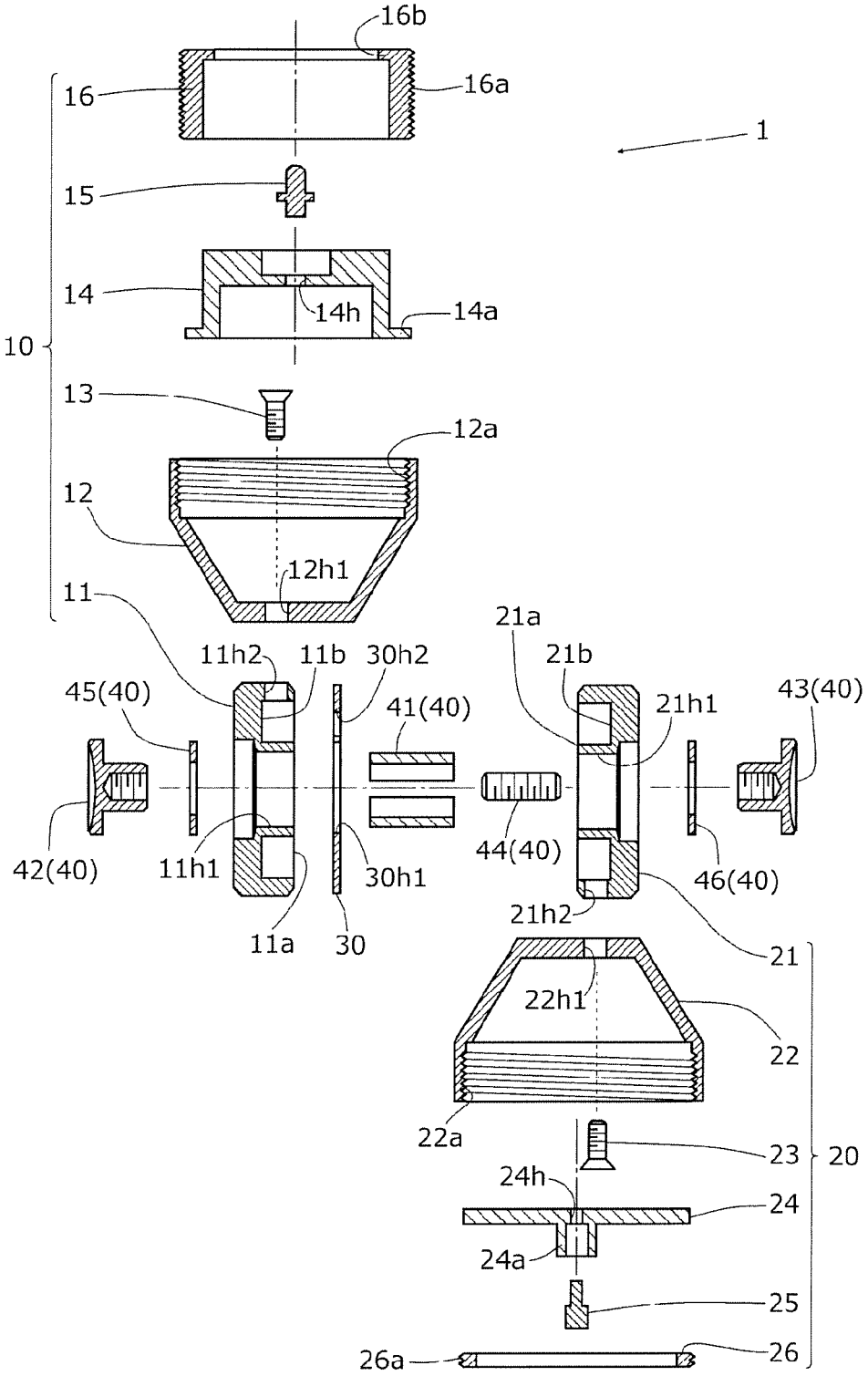
FIG. 4 is a cross-sectional exploded view of the microphone joint in FIG. 3.

FIG. 4 is a cross-sectional exploded view of the joint 1.

The first unit 10 is to be coupled to the unit case C1 (see FIG. 13) of the microphone M described below. The first unit 10 is attachable to and detachable from the unit case C1. The first unit 10 includes a first supporting member 11, a first housing 12, two first screws 13, a first fixing member 14, a first contact pin 15, and a locking screw 16.

Figure 5:
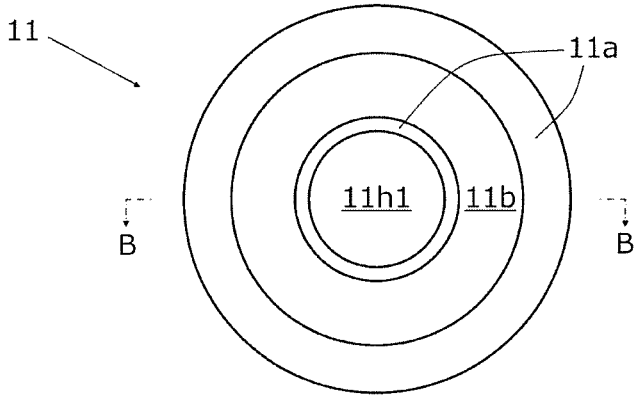
FIG. 5 is a bottom view of a supporting member included in the microphone joint in FIG. 1.

FIG. 5 is a bottom view of the first supporting member 11.

Figure 6:
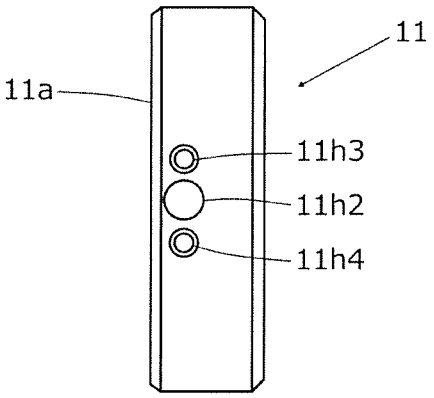
FIG. 6 is a side view of the supporting member in FIG. 5.

FIG. 6 is a side view of the first supporting member 11.

Figure 7:
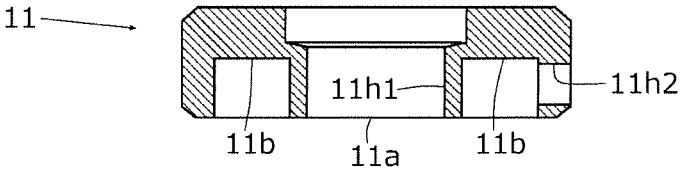
FIG. 7 is a cross-sectional view of the supporting member taken along the line B-B of FIG. 5.

FIG. 7 is a cross-sectional view of the first supporting member 11 taken along the line B-B of FIG. 5.

The first supporting member 11 supports the first housing 12 (see FIG. 3). The first supporting member 11 is composed of conductive metal, such as brass alloy. The first supporting member 11 has a shape of a disk. One of the two surfaces of the first supporting member 11 is a sliding surface 11*a* that abuts on the conductive member 30 and slides on the conductive member 30. The first supporting member 11 has a shaft insertion hole 11*h*1, a groove 11*b*, a cable insertion hole 11*h*2, two screw holes 11*h*3 and 11*h*4, an inner wall, and an outer wall.

The shaft insertion hole 11*h*1 is a hole into which a rotary shaft 41 described below of the coupling member 40 is to be inserted. The shaft insertion hole 11*h*1 is disposed in the center of the first supporting member 11. The shaft insertion hole 11*h*1 extends across the thickness direction (the vertical direction in FIG. 7) of the first supporting member 11. The inner diameter of the shaft insertion hole 11*h*1 in the portion adjacent to the surface (hereinafter referred to as "outer surface") opposite to the sliding surface 11*a* is larger than that in the portion adjacent to the sliding surface 11*a*.

The groove 11*b* is a passage through which a cable (electric wire; not shown) is to be disposed. The groove 11*b* is disposed on the sliding surface 11*a* and has a shape of a ring surrounding the shaft insertion hole 11*h*1. As a result, the inner wall is defined inside the groove 11*b* in the radial direction and the outer wall is defined outside the groove 11*b* in the radial direction.

The cable insertion hole 11*h*2 is a hole into which the cable is to be inserted. The cable insertion hole 11*h*2 extends through the outer circumferential surface of the first supporting member 11. The internal space of the groove 11*b* communicates with the external space of the first supporting member 11 through the cable insertion hole 11*h*2.

The two screw holes 11*h*3 and 11*h*4 extend through the outer circumferential surface of the first supporting member 11, and are disposed on both sides of the cable insertion hole 11*h*2 along the circumferential direction of the first supporting member 11.

Figure 8:
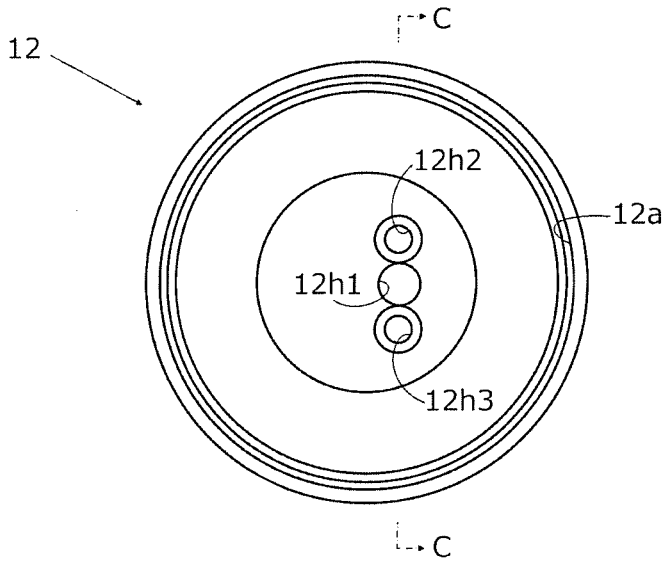
FIG. 8 is a bottom view of a first housing included in the microphone joint in FIG. 1.

FIG. 8 is a bottom view of the first housing 12.

Figure 9:
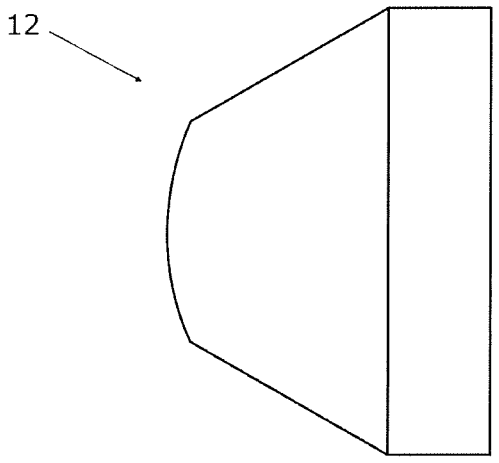
FIG. 9 is a side view of the first housing in FIG. 8.

FIG. 9 is a side view of the first housing 12.

Figure 10:
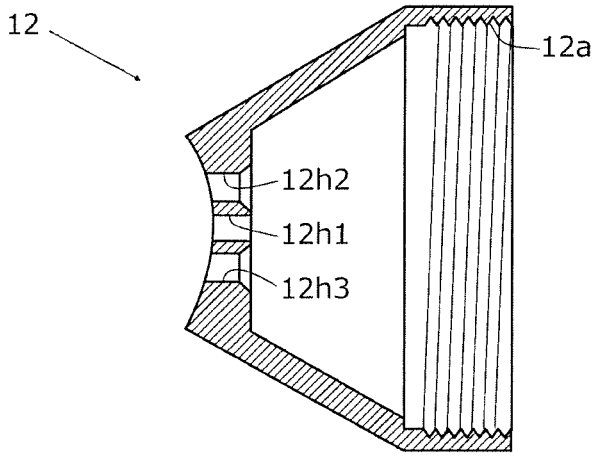
FIG. 10 is a cross-sectional view of the first housing taken along the line C-C of FIG. 8.

FIG. 10 is a cross-sectional view of the first housing 12 taken along the line C-C of FIG. 8.

The first housing 12 accommodates the first fixing member 14 (see FIG. 3). The first housing 12 is composed of conductive metal, such as brass alloy. The first housing 12 has a shape of a hollow circular truncated cone having an open end and a bottom end. The outer surface of the bottom end of the first housing 12 is curved inward along the outer circumferential surface of the first supporting member 11. The first housing 12 has an internally threaded portion 12*a*, a cable insertion hole 12*h*1, and two screw insertion holes 12*h*2 and 12*h*3.

The internally threaded portion 12*a* is disposed on the inner circumferential surface of the first housing 12 adjacent to the open end. The locking screw 16 (see FIG. 3) is fit to the internally threaded portion 12*a*.

The cable insertion hole 12*h*1 is a hole into which the cable is to be inserted. The cable insertion hole 12*h*1 extends through the bottom end of the first housing 12. The internal space of the first housing 12 communicates with the external space of the first housing 12 through the cable insertion hole 12*h*1.

The two screw holes 12*h*2 and 12*h*3 extend through the bottom end of the first housing 12, and are disposed on both sides of the cable insertion hole 12*h*1.

Referring now back to FIGS. 3 and 4, the first screws 13 fasten the first housing 12 to the first supporting member 11. The first screw 13 is a flat head screw, for example. One of the first screws is not shown in FIG. 4.

The first fixing member 14 fixes the first contact pin 15. The first fixing member 14 is composed of an insulating synthetic resin, for example. The first fixing member 14 has a shape of a hollow cylinder with a bottom end. The first fixing member 14 has a pin hole 14*h* and a flange portion 14*a*.

The pin hole 14*h* is disposed in the center of the bottom end of the first fixing member 14. The pin hole 14*h* extends across the thickness direction (the vertical direction in FIG. 4) of the bottom end. The flange portion 14*a* is disposed on the outer circumferential surface of the first fixing member 14 adjacent to the open end.

The first contact pin 15 is electrically connected to an output terminal described below (not shown) of the unit case C1 of the microphone M. The first contact pin 15 is composed of conductive metal. The first contact pin 15 is an example of a first terminal in the present invention.

The locking screw 16 fixes the first fixing member 14 to the first housing 12. The locking screw 16 is composed of conductive metal, such as brass alloy. The locking screw 16 has a shape of a hollow cylinder. The locking screw 16 has a threaded screw 16*a* and a flange portion 16*b*.

The threaded screw 16*a* is disposed on the outer circumferential surface of the locking screw 16. The flange portion 16*b* is disposed on the inner circumferential surface of the locking screw 16 adjacent to one end.

The second unit 20 is to be coupled to the connector case C2 described below (see FIG. 13) of the microphone M. The second unit 20 is attachable to and detachable from the connector case C2. The second unit 20 includes a second supporting member 21, a second housing 22, two second screws 23, a second fixing member 24, a second contact pin 25, and a locking ring 26.

The second supporting member 21 supports the second housing 22. The second supporting member 21 has the same configuration as that of the first supporting member 11. That is, the second supporting member 21 has a sliding surface 21*a*, a shaft insertion hole 21*h*1, a groove 21*b*, a cable insertion hole 21*h*2, two screw holes (not shown), an inner wall, and an outer wall.

The second housing 22 accommodates the second fixing member 24. The second housing 22 has the same configuration as that of the first housing 12. That is, the second housing 22 has an internally threaded portion 22*a*, a cable insertion hole 22*h*1, and two screw holes (not shown).

The second screws 23 fasten the second housing 22 to the second supporting member 21. The second screws 23 each have the same configuration as that of the first screw 13.

The second fixing member 24 fixes the second contact pin 25. The second fixing member 24 is composed of insulating synthetic resin. The second fixing member 24 has a shape of a disk. The second fixing member 24 has a pin hole 24*h* and an accommodating portion 24*a*.

The pin hole 24*h* is disposed in the center of the second fixing member 24. The pin hole 24*h* extends across the thickness direction (the vertical direction in FIG. 4) of the second fixing member 24. The accommodating portion 24*a* has a shape of a hollow cylinder and is disposed in the center of one surface of the second fixing member 24.

The second contact pin 25 is electrically connected to an input terminal described below (not shown) of the connector case C2 of the microphone M. The second contact pin 25 is composed of conductive metal. The second contact pin 25 is an example of a second terminal in the present invention.

The locking ring 26 fixes the second fixing member 24 to the second housing 22. The locking ring 26 is composed of conductive metal, such as brass alloy. The locking ring 26 has a shape of a ring. The locking ring 26 has a threaded screw 26*a*. The threaded screw 26*a* is disposed on the outer circumferential surface of the locking ring 26.

Figure 11:
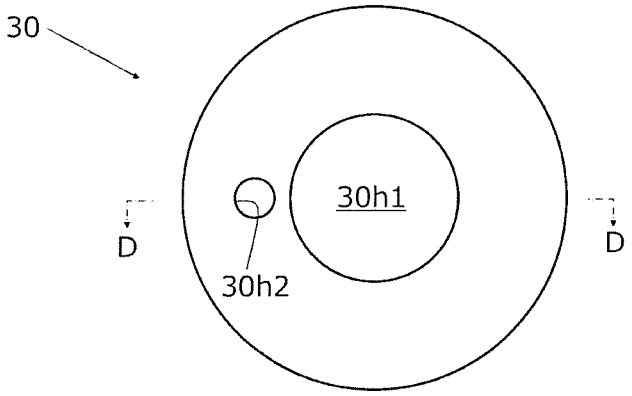
FIG. 11 is a bottom view of a conductive member included in the microphone joint in FIG. 1.

FIG. 11 is a bottom view of the conductive member 30.

Figure 12:
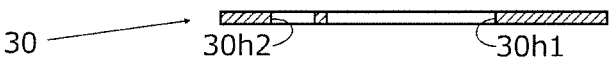
FIG. 12 is a cross-sectional view of the conductive member taken along the line D-D of FIG. 11.

FIG. 12 is a cross-sectional view of the conductive member 30 taken along the line D-D of FIG. 11.

As shown in FIG. 3, the conductive member 30 electrically connects the first supporting member 11 to the second supporting member 21. The conductive member 30 is a conductive cloth having electrical conductivity and resilience, for example. The conductive member 30 has a shape of a disk. The conductive member 30 has a shaft insertion hole 30*h*1 and a cable insertion hole 30*h*2.

The shaft insertion hole 30*h*1 is disposed in the center of the conductive member 30. The shaft insertion hole 30*h*1 extends across the thickness direction (the vertical direction of FIG. 12) of the conductive member 30.

The cable insertion hole 30*h*2 is a hole into which the cable is to be inserted. The cable insertion hole 30*h*2 is disposed between the inner and outer peripheral edges of the conductive member 30.

The conductive member of the present invention may also be a metal plate or mesh having conductivity and resilience across the thickness direction of the conductive member.

As shown in FIG. 3, the coupling member 40 couples the first unit 10, the second unit 20, and the conductive member 30 to each other such that the first unit 10 and the second unit 20 can rotate relative to each other. The coupling member 40 has a rotary shaft 41, a first nut 42, a second nut 43, a threaded screw 44, a first washer 45, and a second washer 46.

The rotary shaft 41 rotatably supports the first supporting member 11 and the second supporting member 21. The rotary shaft 41 is composed of metal, for example. The rotary shaft 41 has a shape of a hollow cylinder having a slit.

The first nut 42, the second nut 43, and the threaded screw 44 rotatably fasten the first unit 10, the second unit 20, and the conductive member 30 to each other. The first nut 42 and the second nut 43 each have a shape of a hollow cylinder with a bottom end and a flange portion on the outer circumferential surface adjacent to the bottom end. The threaded screw 44 is a continuous thread having no head.

The first washer 45 or the second washer 46 is a flat washer, for example.

Method of Manufacturing Joint

A method of manufacturing the joint 1 will now be described with reference to FIGS. 3 and 4.

First, the first unit 10 is assembled from the first supporting member 11, the first housing 12, the first screws 13, the first fixing member 14, the first contact pin 15, and the locking screw 16.

The first supporting member 11 is attached to the first housing 12 with the two first screws 13. The outer circumferential surface of the first supporting member 11 comes into contact with the bottom end of the first housing 12. The first screws 13 are inserted into the screw holes 12*h*2 and 12*h*3 (see FIG. 8) from the inside of the first housing 12 and fit to the screw holes 11*h*3 and 11*h*4 (see FIG. 6). Then, the cable insertion hole 11*h*2 faces the cable insertion hole 12*h*1.

The first contact pin 15 is fit to the pin hole 14*h* of the first fixing member 14. One end of the first contact pin 15 extends across the thickness direction (the vertical direction in FIG. 4) of the bottom end of the first fixing member 14.

The first fixing member 14 is accommodated in the first housing 12 from the end having the flange portion 14*a*, and then fixed to the first housing 12 with the locking screw 16. The locking screw 16 is attached to the first housing 12. That is, the threaded screw 16*a* of the locking screw 16 is fit to the internally threaded portion 12*a* of the first housing 12. As a result, the flange portion 14*a* of the first fixing member 14 is held between the first housing 12 and the locking screw 16. The bottom end of the first fixing member 14 comes into contact with the flange portion 16*b* of the locking screw 16. The side of the flange portion 16*b* of the locking screw 16 is disposed outside the open end of the first housing 12 (the upper side of FIG. 3).

Second, the second unit 20 is assembled from the second supporting member 21, the second housing 22, the second screws 23, the second fixing member 24, the second contact pin 25, and the locking ring 26.

The second supporting member 21 is attached to the second housing 22 with the two second screws 23. The outer circumferential surface of the second supporting member 21 comes into contact with the bottom end of the second housing 22. The second screws 23 are inserted into the screw insertion holes (not shown) of the second housing 22 from the inside of the second housing 22 and fit to the screw holes (not shown) of the second supporting member 21. Then, the cable insertion hole 21*h*2 faces the cable insertion hole 22*h*1.

The second contact pin 25 is fit to the pin hole 24*h* of the second fixing member 24. One end of the second contact pin 25 extends across the thickness direction (the vertical direction in FIG. 4) of the second fixing member 24. The other end of the second contact pin 25 is accommodated in the accommodating portion 24*a*.

The second fixing member 24 is accommodated in the second housing 22 from the surface opposite to the surface having the accommodating portion 24*a*, and then fixed to the second housing 22 with the locking ring 26. The locking ring 26 is attached to the second housing 22. That is, the threaded screw 26*a* of the locking ring 26 is fit to the internally threaded portion 22*a* of the second housing 22. As a result, the second fixing member 24 is held between the second housing 22 and the locking ring 26.

Third, the first unit 10, the second unit 20, and the conductive member 30 are coupled to each other with the coupling member 40.

The conductive member 30 is disposed between the sliding surface 11*a* of the first supporting member 11 and the sliding surface 21*a* of the second supporting member 21. The sliding surface 11*a* of the first supporting member 11 and the sliding surface 21*a* of the second supporting member 21 thus faces with the conductive member 30 disposed therebetween.

The rotary shaft 41 is then inserted into the shaft insertion hole 11*h*1 of the first supporting member 11 and the shaft insertion hole 21*h*1 of the second supporting member 21 and is disposed in the shaft insertion hole 11*h*1 and the shaft insertion hole 21*h*1. That is, the rotary shaft 41 is disposed in the first supporting member 11 and the second supporting member 21.

The first washer 45 is disposed in the outspread portion of the shaft insertion hole 11*h*1 from the outer surface of the first supporting member 11. The first nut 42 is inserted into the first washer 45 and the rotary shaft 41 from the outer surface of the first supporting member 11.

The second washer 46 is disposed in the outspread portion of the shaft insertion hole 21*h*1 from the outer surface of the second supporting member 21. The second nut 43 is inserted into the second washer 46 and the rotary shaft 41 from the outer surface of the second supporting member 21.

The threaded screw 44 is disposed inside the rotary shaft 41 and is then fit to the first nut 42 and the second nut 43.

The assembly process described above achieves the complete state of the joint 1 shown in FIG. 3. The first unit 10 is supported by the second unit 20 with the conductive member 30 and the rotary shaft 41. The first unit 10 is rotatable relative to the second unit 20. The second unit 20 is supported by the first unit 10 with the conductive member 30 and the rotary shaft 41. The second unit 20 is rotatable relative to the first unit 10. That is, the sliding surface 11*a* of the first supporting member 11 and the sliding surface 21*a* of the second supporting member 21 slide on the conductive member 30, and the first unit 10 and the second unit 20 is thereby rotatable relative to each other about the rotary shaft 41. The first supporting member 11 and the second supporting member 21 constitute movable parts of the joint 1. The first unit 10 and the second unit 20 can rotate within an angular range not causing contact of the first housing 12 with the second housing 22.

The internal space of the first housing 12 communicates with the internal space of the groove 11*b* of the first supporting member 11 through the cable insertion hole 12*h*1 of the first housing 12 and the cable insertion hole 11*h*2 of the first supporting member 11. The internal space of the groove 11*b* of the first supporting member 11 communicates with the internal space of the groove 21*b* of the second supporting member 21 through the cable insertion hole 30*h*2 of the conductive member 30. The internal space of the groove 21*b* of the second supporting member 21 communicates with the internal space of the second housing 22 through the cable insertion hole 21*h*2 of the second supporting member 21 and the cable insertion hole 22*h*1 of the second housing 22.

The first contact pin 15 is electrically connected to the second contact pin 25 through the cable (not shown). As indicated with the two dotted chain lines of FIG. 3, the cable is inserted into the internal space of the first housing 12, the cable insertion hole 12*h*1 of the first housing 12, the cable insertion hole 11*h*2 of the first supporting member 11, the internal space of the groove 11*b*, the cable insertion hole 30*h*2 of the conductive member 30, the internal space of the groove 21*b*, the cable insertion hole 21*h*2 of the second supporting member 21, the cable insertion hole 22*h*1 of the second housing 22, and the internal space of the second housing 22. Thus, the cable is not broken by the rotation of the movable parts.

Relation Among First Unit 10, Second Unit 20, and Conductive Member 30

The relation among the first unit 10, the second unit 20, and the conductive member 30 will now be described with reference to FIGS. 2 and 3.

The conductive member 30 is disposed between the first unit 10 and the second unit 20. The conductive member 30 is urged onto the sliding surface 21*a* of the second supporting member 21 by the first supporting member 11 and onto the sliding surface 11*a* of the first supporting member 11 by the second supporting member 21. As described above, the conductive member 30 is resilient conductive cloth. The conductive member 30 is compressed by the first supporting member 11 and the second supporting member 21 in the thickness direction (the horizontal direction in FIG. 3) of the conductive member 30. Thus, the movable parts (the first supporting member 11 and the second supporting member 21) and the conductive member 30 are electrically connected to each other at a large number of electrical contacts. This number of electrical contacts is larger than that of conventional movable parts including mutually abutting metal members. In other words, the electrical connection between the movable parts of the joint 1 is ensured (stabilized) by the conductive member 30.

The conductive member 30 is disposed between the outer wall of the first supporting member 11 and the outer wall of the second supporting member 21 and between the inner wall of the first supporting member 11 and the inner wall of the second supporting member 21. Thus, electromagnetic waves outside the joint 1 do not penetrate the joint 1 through the outer or inner walls of the movable parts.

The frictional force between the sliding surface 11*a* of the first supporting member 11 and the conductive member 30 increases with the fastening force of the coupling member 40 and decreases with the fastening force of the coupling member 40. Similarly, the frictional force between the sliding surface 21*a* of the second supporting member 21 and the conductive member 30 increases with the fastening force of the coupling member 40 and decreases with the fastening force of the coupling member 40.

In general, the surface of a conductive cloth has a smaller coefficient of friction than a metal. That is, the sliding surface 11*a* of the first supporting member 11 and the sliding surface 21*a* of the second supporting member 21 readily slide on the surface of the conductive member 30. Thus, the movable parts of the joint 1 are more readily movable than conventional movable parts including mutually abutting metal members. In other words, the movability of the movable parts is ensured even when the coupling member 40 is further fastened to increase the force (hereinafter referred to as "fixing force") of fixing the rotational position (angle) of the first supporting member 11 relative to the second supporting member 21.

Movement of Joint

The movement of the joint 1 will now be described with reference to FIGS. 2 and 3.

The first unit 10 is rotated relative to the second unit 20 about the rotary shaft 41 along the circumferential direction (the clockwise or counterclockwise direction in FIG. 2) of the rotary shaft 41 by external force applied by a user of the joint 1, for example. When the external force is removed, the first unit 10 is fixed at a predetermined angle from the second unit 20.

The second unit 20 is rotated relative to the first unit 10 about the rotary shaft 41 along the circumferential direction of the rotary shaft 41 by external force applied by the user of the joint 1, for example. When the external force is removed, the second unit 20 is fixed at a predetermined angle from the first unit 10.

Exemplary Use of Joint

An exemplary use of the joint 1 will now be described.

Figure 13:
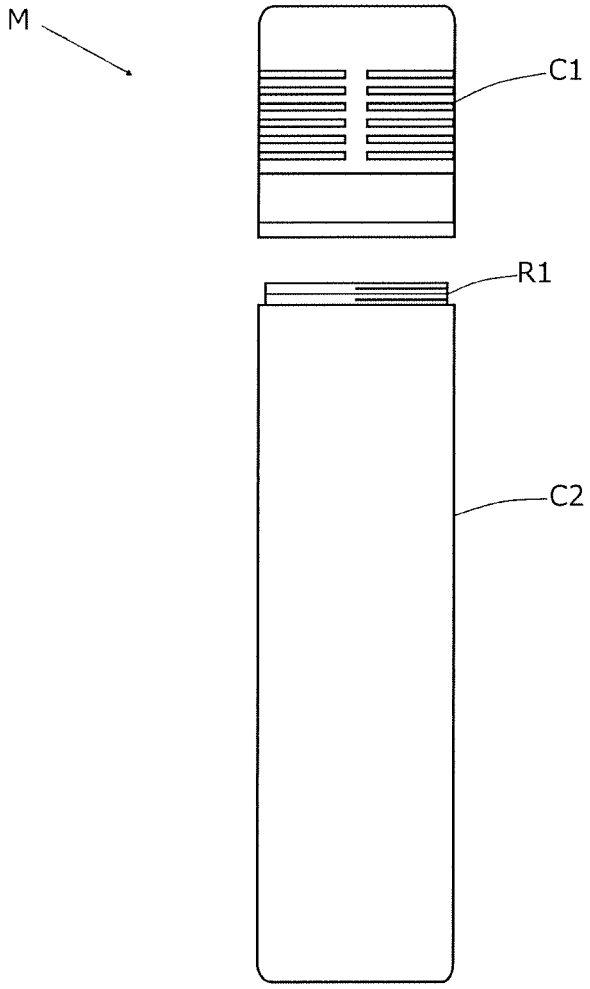
FIG. 13 is a front exploded view of a microphone to which a microphone joint of the present invention can be applied.

FIG. 13 is a front exploded view of a microphone to which the joint of the present invention can be applied. The microphone M includes a microphone unit (not shown), a unit case C1, an output connector (not shown), a connector case C2, and a locking screw R1.

The microphone unit converts sound waves from a sound source into electrical signals and outputs the electrical signals to the output connector. The microphone unit is a condenser microphone unit, for example. The microphone unit has a sound collecting axis along the direction (the vertical direction in FIG. 13) of vibration of a diaphragm (not shown). The microphone unit is accommodated in the unit case C1.

The unit case C1 accommodates the microphone unit. The unit case C1 is composed of metal, such as brass alloy. The unit case C1 has a shape of a hollow cylinder with an open end and a bottom end. The unit case C1 has an internally threaded portion (not shown) and an output terminal (not shown). The internally threaded portion is disposed on the inner circumferential surface of the unit case C1 adjacent to the open end. The output terminal is accommodated adjacent to the open end of the unit case C1.

The output connector outputs the electrical signals from the microphone unit to an external device (not shown), for example. The output connector is an output connector conforming to JEITA Standard RC-5236 "Circular Connector, Latch-Lock Type for Audio Equipment", for example.

The connector case C2 accommodates the output connector. The connector case C2 is composed of metal, such as brass alloy. The connector case C2 has a shape of a hollow cylinder. The connector case C2 has an internally threaded portion (not shown) and an input terminal (not shown). The internally threaded portion is disposed on the inner circumferential surface of the connector case C2 adjacent to one end of the connector case C2. The output connector is accommodated in the connector case C2 adjacent to the other end of the connector case C2. The locking screw R1 has a threaded screw on the outer circumferential surface and is fit to the internally threaded portion of the connector case C2. The input terminal is accommodated in the locking screw R1.

The threaded screw of the locking screw R1 is fit to the internally threaded portion of the unit case C1, and the unit case C1 is thereby coupled to the connector case C2. The unit case C1 is attachable to and detachable from the connector case C2. That is, the microphone unit of the microphone M is replaceable. When the unit case C1 is coupled to the connector case C2, the output terminal of the unit case C1 is electrically connected to the input terminal of the connector case C2.

Figure 14:
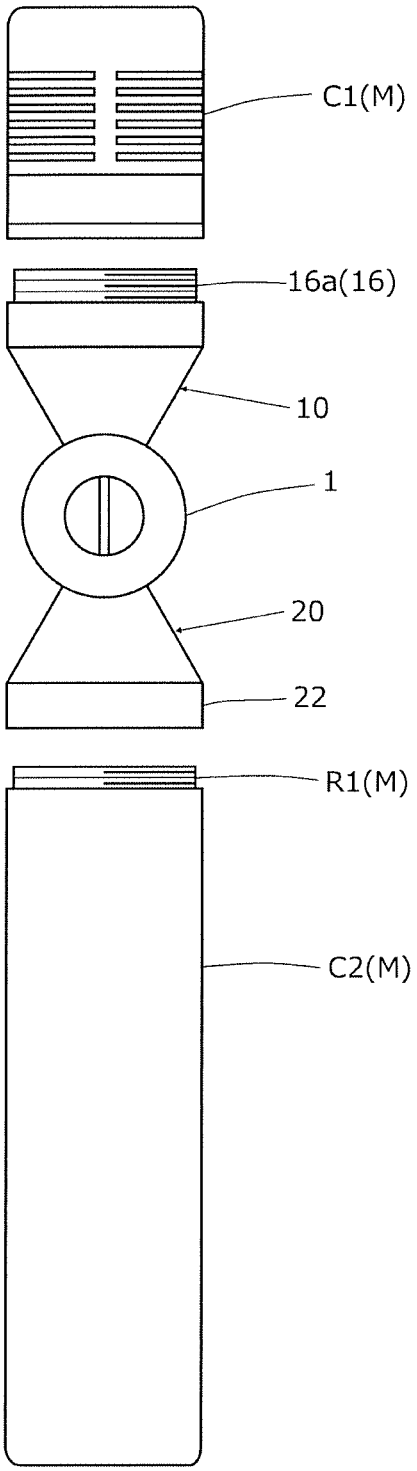
FIG. 14 is a front exploded view of a microphone provided with a microphone joint of the present invention.

FIG. 14 is a front exploded view of the microphone M provided with the joint of the present invention.

Figure 15:
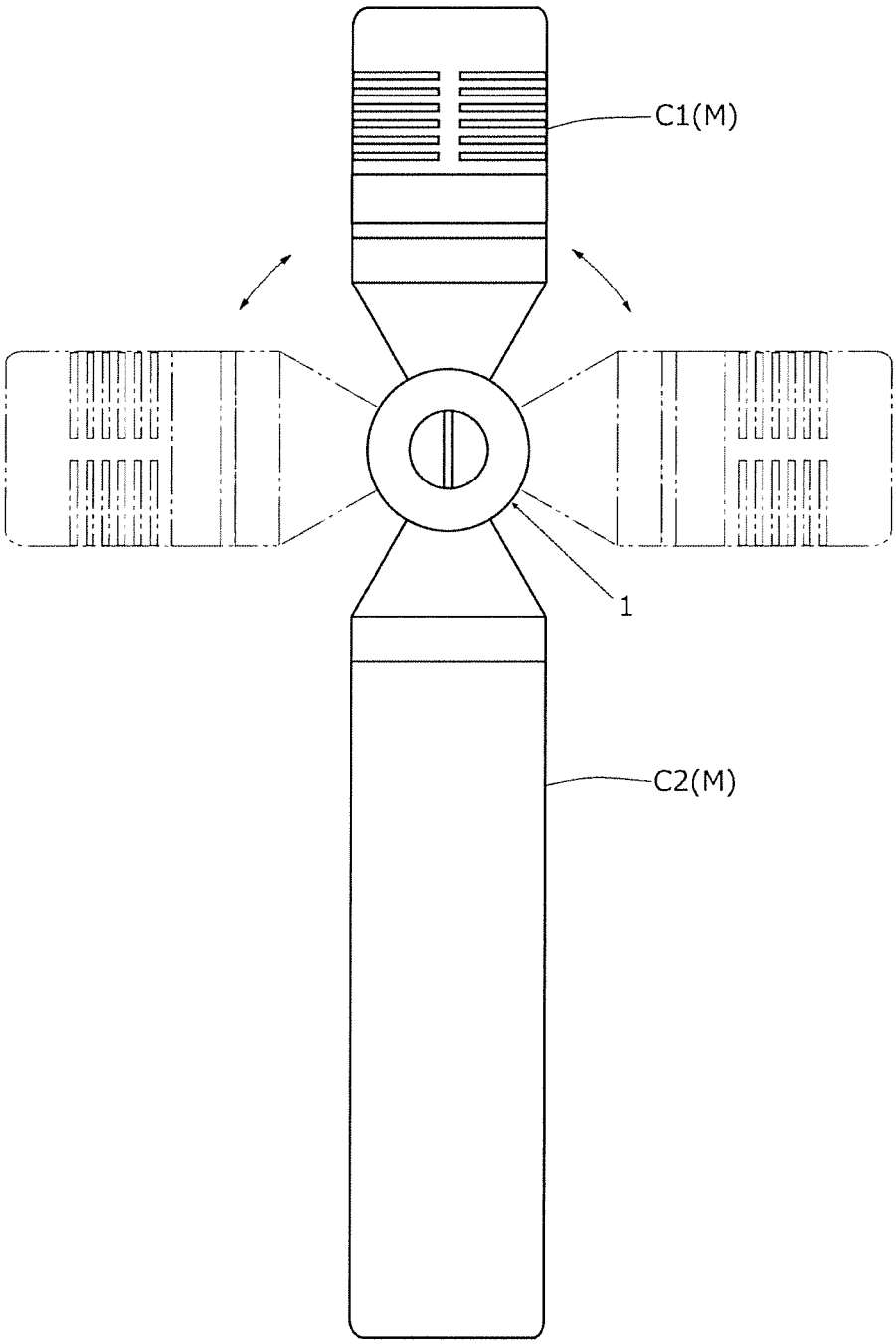
FIG. 15 is a front view of a microphone provided with a microphone joint of the present invention.

FIG. 15 is a front view of the microphone M provided with the joint of the present invention.

The two dotted chain lines of FIG. 15 indicate states of the unit case C1 rotating relative to the connector case C2.

The threaded screw 16*a* of the locking screw 16 is fit to the internally threaded portion of the unit case C1, and the first unit 10 is thereby coupled to the unit case C1. As described above, the first unit 10 is attachable to and detachable from the unit case C1. Thus, in the microphone M provided with the joint of the present invention, the unit case is replaceable. In other words, in the microphone M provided with the joint of the present invention, the microphone unit is replaceable. When the first unit 10 is coupled to the unit case C1, the first contact pin 15 (see FIG. 3) of the first unit 10 is electrically connected to the output terminal of the unit case C1.

The threaded screw of the locking screw R1 is fit to the internally threaded portion 22*a* (see FIG. 3) of the second housing 22, and the second unit 20 is thereby coupled to the connector case C2. As described above, the second unit 20 is attachable to and detachable from the connector case C2. Thus, in the microphone M provided with the joint of the present invention, the connector case is replaceable. In other words, in the microphone M provided with the joint of the present invention, the output connector is replaceable. When the second unit 20 is coupled to the connector case C2, the second contact pin 25 (see FIG. 3) of the second unit 20 is electrically connected to the input terminal of the connector case C2.

The electrical signals from the microphone unit are output through the output terminal of the unit case C1, the first contact pin 15, the cable (not shown), the second contact pin 25, the input terminal of the connector case C2, and the output connector to the external device.

Electromagnetic waves outside the microphone M are shielded by the electromagnetic shield composed of the unit case C1, the joint 1, the connector case C2, and the output connector so as not to reach the microphone unit accommodated in the unit case C1.

The unit case C1 is rotated relative to the connector case C2 about the rotary shaft 41 (see FIG. 3) along the circumferential direction (the clockwise or counterclockwise direction in FIG. 15) of the rotary shaft 41 by external force applied by the user of the microphone M, for example. When the external force is removed, the unit case C1 is fixed at a predetermined angle from the connector case C2. As a result, the sound collecting axis of the microphone unit is fixed at a predetermined angle from the connector case C2. That is, the sound collecting axis of the microphone unit can be adjusted by the rotation of the unit case C1 with the joint 1.

CONCLUSION

In the microphone joint 1 according to the embodiments described above, the first unit 10 is supported by the second unit 20 with the resilient conductive member 30. The first unit 10 is rotatable relative to the second unit 20. The conductive member 30 is urged (compressed) by the first unit 10 and the second unit 20 in the thickness direction of the conductive member 30. Thus, the first unit 10, the second unit 20, and the conductive member 30 are electrically connected to each other at a large number of electrical contacts. Accordingly, the electrical connection between the first unit 10 and the second unit 20 is stabilized.

The first supporting member 11 has the sliding surface 11*a* onto which the conductive member 30 is urged by the second supporting member 21. The sliding surface 11*a* of the first supporting member 11 slides on the conductive member 30. Thus, the first unit 10 is supported by the second unit 20 with the conductive member 30 and the rotary shaft 41. The first unit 10 is rotatable relative to the second unit 20.

The second supporting member 21 has the sliding surface 21*a* onto which the conductive member 30 is urged by the first supporting member 11. The sliding surface 21*a* of the second supporting member 21 slides on the conductive member 30. Thus, the second unit 20 is supported by the first unit 10 with the conductive member 30 and the rotary shaft 41. The second unit 20 is rotatable relative to the first unit 10.

As described above, the sliding surface 11*a* of the first supporting member 11 and the sliding surface 21*a* of the second supporting member 21 slide on the conductive member 30, and the first unit 10 and the second unit 20 can thereby rotate relative to each other about the rotary shaft 41. Thus, the movable parts (the first supporting member 11 and the second supporting member 21) of the joint 1 are more readily movable than conventional movable parts including mutually abutting metal members. That is, the movability of the movable parts of the joint 1 is ensured even when the coupling member 40 is further fastened to increase the fixing force in the movable parts.

As described above, the joint of the present invention includes movable parts having preferable electrical connection, fixing force, and movability. In a microphone including the joint of the present invention, the sound collecting axis of a microphone unit can be adjusted while maintaining preferable electromagnetic (electrostatic) shield.

The conductive member 30 has the cable insertion hole 30*h*2 into which the cable for connecting the first contact pin 15 to the second contact pin 25 is to be inserted. Thus, the cable can connect the first contact pin 15 to the second contact pin 25 without being blocked by the conductive member 30.

The conductive member of the present invention may also be electrically conductive piles electrostatically flocked on the sliding surface of at least one of the first support and the second support, for example.

The invention claimed is:

1. A microphone joint to be coupled to a unit case accommodating a microphone unit and a connector case accommodating a connector configured to output signals from the microphone unit to an external device, the microphone joint comprising:

a first unit to be coupled to the unit case;

a second unit to be coupled to the connector case; and a conductive member disposed between the first unit and the second unit, wherein the first unit is supported by the second unit with the conductive member and is rotatable relative to the second unit, the conductive member has resilience, the first unit includes a first terminal to be connected to an output terminal of the unit case, the second unit includes a second terminal to be connected to an input terminal of the connector case, and the conductive member has an insertion hole into which an electric wire for connecting the first terminal and the second terminal is to be inserted.

2. A microphone joint to be coupled to a unit case accommodating a microphone unit and a connector case accommodating a connector configured to output signals from the microphone unit to an external device, the microphone joint comprising:

a first unit to be coupled to the unit case;

a second unit to be coupled to the connector case; and a conductive member disposed between the first unit and the second unit; and a rotary shaft, wherein the first unit is supported by the second unit with the conductive member and is rotatable relative to the second unit, the conductive member has resilience, the first unit includes a first support in which the rotary shaft is to be disposed, the second unit includes a second support in which the rotary shaft is to be disposed, the conductive member is disposed between the first support and the second support, and the first support has a sliding surface configured to slide on the conductive member.

3. The microphone joint according to claim 2, wherein the second support urges the conductive member onto the sliding surface.

4. The microphone joint according to claim 2, wherein the second support has a sliding surface configured to slide on the conductive member.

5. The microphone joint according to claim 4, wherein the first support urges the conductive member of the second support onto the sliding surface.

6. The microphone joint according to claim 1, wherein the first unit is attachable to and detachable from the unit case.

7. The microphone joint according to claim 6, wherein the first terminal is connected to the output terminal when the first unit is coupled to the unit case.

8. The microphone joint according to claim 1, wherein the second unit is attachable to and detachable from the connector case.

9. The microphone joint according to claim 8, wherein the second terminal is connected to the input terminal when the second unit is coupled to the connector case.

* * * * *